US011700928B2

(12) United States Patent
Zheng et al.

(10) Patent No.: US 11,700,928 B2
(45) Date of Patent: Jul. 18, 2023

(54) DISPENSER WITH REPLACEABLE INNER CONTAINER

(71) Applicant: APR Beauty Group Inc, Toronto (CA)

(72) Inventors: Min-Yan Zheng, Richmond Hill (CA); Feng-Ying Fu, Markham (CA)

(73) Assignee: APR Beauty Group Inc, Toronto (CA)

( * ) Notice: Subject to any disclaimer, the term of this patent is extended or adjusted under 35 U.S.C. 154(b) by 203 days.

(21) Appl. No.: 17/230,926

(22) Filed: Apr. 14, 2021

(65) Prior Publication Data

US 2022/0330681 A1 Oct. 20, 2022

(51) Int. Cl.

| | |
|---|---|
| ***B05B 11/00*** | (2023.01) |
| ***A45D 34/04*** | (2006.01) |
| ***B05B 11/10*** | (2023.01) |

(52) U.S. Cl.

CPC ..... *A45D 34/04* (2013.01); *B05B 11/0038* (2018.08); *B05B 11/0054* (2013.01); *B05B 11/1001* (2023.01); *A45D 2200/055* (2013.01); *A45D 2200/056* (2013.01)

(58) Field of Classification Search

CPC ..... B05B 11/0054; B05B 11/1001; B05B 11/1045; B05B 11/0038; A45D 234/005; B65D 83/384

See application file for complete search history.

(56) References Cited

U.S. PATENT DOCUMENTS

| | | | | |
|---|---|---|---|---|
| 7,568,598 | B2 | 8/2009 | Ophardt et al. | |
| 9,370,233 | B2 | 6/2016 | Jung | |
| 2002/0025211 | A1* | 2/2002 | Gueret | B65D 83/0011 401/175 |
| 2007/0075102 | A1* | 4/2007 | Moore | B05B 11/0032 222/321.7 |
| 2020/0017272 | A1* | 1/2020 | Okude | B05B 11/0054 |
| 2021/0000240 | A1* | 1/2021 | Lee | A45D 34/00 |
| 2022/0218088 | A1* | 7/2022 | Hwang | B05B 11/1001 |

FOREIGN PATENT DOCUMENTS

WO WO-2015004380 A1 * 1/2015 ..... A45D 40/0075

* cited by examiner

*Primary Examiner* — Paul R Durand
*Assistant Examiner* — Randall A Gruby
(74) *Attorney, Agent, or Firm* — Jason L DeFrancesco

(57) ABSTRACT

A dispenser for dispensing a liquid product, the dispenser comprising a housing, a pump assembly, a dispensing head, and an inner container. The inner container accommodates the liquid product and is configured to be inserted into a cavity of the housing. The inner container is replaceable and detachably connected to the housing such that the housing, the pump assembly, and the dispensing head can be retained for reuse while the inner container can be replaced with a new inner container. A protrusion is provided on an underside of the inner container that a user can grip to rotate the inner container in a clockwise or anticlockwise direction to disengage the inner container from the housing.

18 Claims, 8 Drawing Sheets

DISPENSER WITH REPLACEABLE INNER CONTAINER

BACKGROUND

Field

The present disclosure relates to a dispenser for a dispensing liquid product. More particularly, the present disclosure relates to a dispenser with a replaceable inner container that houses a liquid product.

Description of the Related Art

A liquid product dispenser is used for storing the liquid product inside the containers and dispense the liquid product as per user requirement. Conventional dispensers are used for storing liquid product which are often disposable. These dispensers usually have a fixed container portion that is disposed along with the dispenser body after use. The disposable container portion usually comes with a dispenser head, a pump assembly, and a single-use type container that is not capable of being reused. These dispensers are used in storing liquid based or gel-based formulations that can be dispensed directly onto the skin of the user. The liquid product includes soap based liquid products, cosmetic formulations, skin care liquid products and the like.

U.S. Pat. No. 7,568,598B2 to Gotohti com Inc, discloses about a bottle-like reservoir having an opening, a piston pump mechanism having a piston chamber and coupled to the opening of the reservoir and a piston member reciprocally slidable in the piston chamber to dispense flowable material, an actuator member having a support member fixedly coupled to the reservoir about its opening and a presser member engaging the piston extension and pivotally coupled to the support member for movement between an extended position and a retracted position, the dispenser is later disposed of after use.

Existing technologies disclose about a conventional method of dispensing the liquid products that is later disposed when the product is exhausted. A new dispenser is purchased each time along with the liquid product, whenever the liquid product is exhausted or a different liquid product is to be used by user. These conventional methods of disposing off the dispenser upon being exhausted with anew dispenser or purchasing different dispensers for accumulating different liquid product leads to accumulation of large number of plastics that ultimately leads to incineration of plastics. Purchasing dispensers each time may include a lot of expenses and liquid product. The incineration of plastic may further lead to environmental degradation and increase in carbon footprint. These incinerated plastics are later burnt out along with other waste materials that leads to liquid product of toxic fumes.

In order to overcome the above-mentioned limitations, there exists a need of developing a sustainable liquid product dispenser that is replenished by a user upon being exhausted, simultaneously managing the over wastage of liquid product, thus reducing incineration of plastic and ultimately minimizes carbon footprint. The present disclosure is therefore related to a dispenser having a replaceable inner container that is easily detached from the dispenser and replenished easily, thereby making the liquid product reusable, refillable and cost-effective.

SUMMARY

It is an object of the present disclosure to provide a dispenser with a replaceable inner container that is easily detached during replacement.

It is an object of the present disclosure to provide a gripping means on the replaceable inner container that is preferably configured ergonomically for easy, comfortable grip by a user during replacement of the inner container.

A dispenser in accordance with a first embodiment of the present disclosure comprises a housing, a replaceable inner container, a dispensing head, a pump assembly, a collar, and a top cover. The inner container is detachably connected to the housing and the pump assembly is connected to the housing through the collar. The inner container stores a liquid product that is to be dispensed onto a surface, wherein the liquid product is selected from at least one of the cosmetic liquid products or medicinal liquid products. The liquid product stored in the inner container is a flowable liquid product for e.g. a solution, suspension, a viscous liquid, etc.

The replaceable inner container is detachably attached to the housing such that the housing, the collar, the pump assembly, and the dispensing head can be reused while the inner container can be replaced or refilled when the cosmetic product that is accommodated inside the inner container has been completely exhausted.

According to an aspect of the current disclosure, the housing has a sidewall extending along a central longitudinal axis and has an open distal end and an open proximal end forming a hollow cavity.

A top cover is detachably mounted on a neck at the proximal end of the housing to prevent the accumulation of dirt and dust inside the inner container. The top cover slidably fits on the neck of the housing by means of a snap fitment between an at least one groove on an inner surface of the cover and at least one corresponding protrusion on an outer surface of the neck.

In alternate embodiments, the top cover and the housing may be coupled by any other engagement means capable of removably coupling the top cover and the housing e.g. j-lock, magnetic engagement, screw threads, etc.

In certain embodiments, the housing may include a window or made up of a transparent material formed in the sidewall to reveal the inner container positioned coaxially inside the housing. Optionally, the inner container may be made of a transparent material or have a transparent window so that through the window of the housing the product stored inside the inner container may be made visible.

According to another aspect of the current disclosure, the inner container is positioned co-axially inside the hollow cavity of the housing for storing the liquid product. The inner container comprises a hollow tubular body and a base plug. The hollow tubular body has an open distal end and an open proximal end. The base plug is coupled at the open distal end of the tubular body and wherein the base plug defines a bottom for the inner container. The base plug is fixedly coupled to the tubular body such that they behave as a single unit.

According to yet another aspect of the current disclosure, the proximal end of the inner container detachably fits within the open proximal end of the housing. The locking means are present on the outer circumference of the open proximal end of the inner container. The locking means of the inner container allows the inner container to be rotatably coupled to the housing in a removable manner. The locking means in the present embodiment preferably a J-lock formed on the outer surface of the inner container which easily engages and disengages with the housing. The locking means has a vertical rib and a lateral rib extending in a circumferential direction. Further, the locking means has a protrusion below the lateral rib forming a groove with the vertical rib in which an at least one inner lug of the housing is engaged in order to removably secure the inner container inside the housing. The inner lug of the housing is located on the inner surface of the sidewall of housing near the proximal end of the housing. The inner container is thereby connected to the housing using a J-lock which is easily connected and disconnected.

In alternate embodiments, the locking means for detachably coupling the housing with the inner container may be any other means than a J-lock such as a magnetic engagement, screw threads, etc. known in the art.

According to yet another aspect of the current disclosure, the inner container is rotated with respect to the housing for replacing the inner container, and in order to rotate the inner container the user grips and rotates a bottom of the base plug through the open distal end of the housing. The base plug is thus rotated slightly along the circumference of the inner circumference of the housing to lock and unlock the locking means of the inner container from the at least one inner lug of the housing for replacing the inner container.

In the locked position, the at least one lug of the housing is present in the groove of the at least one locking means of the inner container.

In order, to unlock the inner container from the housing for replacement, the inner container is rotated in a first direction preferably in an anti-clockwise direction. As the inner container is rotated in the first direction, the at least one lug of the housing comes out of the groove of the locking means by overriding the protrusion of the locking means and moves in a circumferential direction along the lateral rib and thus disengaging from the locking means of the inner container.

To lock a new inner container with the housing, the inner container is fully inserted in the cavity of the housing through the distal end of the housing and is rotated in a direction opposite to the first direction i.e. preferably in a clockwise direction. As the new inner container is rotated, the at least one lug of the housing moves along the circumferential surface of the lateral rib of the locking means, and the at least one lug enters into the groove by overriding the protrusion of the locking means for locking the new inner container to housing.

In the exemplary embodiment, the inner container and the base plug are not integral however, in alternate embodiments, the inner container and the base plug may be made as a single integral piece.

According to an aspect of the present disclosure, the base plug provides a gripping means on the underside of the base plug. In a preferred embodiment, the gripping means includes a protrusion on the underside of the base plug that allows the user to comfortably grip the inner container from a bottom side during rotation of the inner container for locking and unlocking the inner container from the housing.

According to an aspect of the present disclosure, the base plug comprises of sidewall having a proximal end and a distal end, and a horizontal wall. The horizontal wall is set inwardly of and spaced from the distal end of the sidewall of the base plug. A bottom surface of the horizontal wall along with a sidewall of the base plug thus forms a recess at bottom of the base plug. The base plug further includes an S-shaped protrusion as a gripping means provided on the bottom surface of the horizontal wall of the base plug that extends towards the distal end. A depth of the recess is substantially more than half of a height of the base plug. A length of the S-shaped protrusion is substantially equal to greater than a width of the base plug. In the exemplary embodiment, S-shaped protrusion extends in the recess of the base plug such that a first end of the S-shaped protrusion is joined to an inner circumference of the sidewall of the base plug, and a second end of the S-shaped protrusion is joined to the inner circumference of the sidewall of the base plug in a region substantially opposite to a joining region of the first end.

According to yet another aspect of the present disclosure, a height of the S-shaped protrusion is equal to the depth of the recess of the base plug, and wherein the S-shaped protrusion extends from the bottom surface of the horizontal wall to the distal end of the base plug. Further, an aperture is provided within the S-shaped protrusion in which inwardly curled fingers of a user can locate and engage. This allows the user to securely grip the base plug of the inner container in a comfortable and natural manner. The aperture creates a ring or grip for the user to grasp the S-shaped protrusion and rotate the inner container. The dimension selected for the aperture provides a defined space for the user to place the finger to hold the base plug. The aperture is located at about a mid-length of the S-shaped protrusion and has a length substantially less than half of the length of the S-shaped protrusion. The height of the aperture is more than half of the height of the S-shaped protrusion.

In alternate embodiments, the protrusion for gripping at the base plug may be of any other shape other than an S-shape as long as it provides a comfortable gripping surface with or without an aperture in it in which a user can insert his/her finger.

According to yet another aspect of the present disclosure, an outer surface of the sidewall of the base plug proximate to the proximal end of the base plug comprises of multiple protrusions on an outer circumference of the base plug. The multiple protrusions engage with the corresponding snap grooves provided on the inner circumference of the sidewall of the inner container proximate to the distal end.

According to yet another aspect of the present disclosure, the base plug engages with the inner container by rotating the base plug at a certain degree in either clockwise or anti-clockwise direction until the protrusions on the outer surface of the base plug perfectly align with each of the snap grooves of the inner container for snap-fitment and are locked.

During engagement and disengagement of the base plug from the housing, the user places the finger inside the through aperture of S-shaped protrusion and holds the S-shaped protrusion firmly to rotate the inner container at a certain degree in a particular direction.

According to an embodiment, the length of the S-shaped protrusion ranges from about 15 mm-45 mm, more preferably about 25 mm-35 mm. The height of the S-shaped protrusion ranges from 3 mm-9 mm, more preferably from 4 mm-7 mm. The width of the S-shaped protrusion from 1 mm-3.5 mm, preferably from 1.5 mm-2.5 mm. According to an alternate embodiment, the height and width of the S-shaped protrusion may vary along its length.

According to a first embodiment, the height of the aperture is preferably 3.3 mm, the length is preferably 10 mm, and the width is preferably 1.9 mm. However, according to alternate embodiments, the dimensions of the aperture of the S-shaped protrusion may vary and be less or greater than the dimensions mentioned for the first embodiment.

In the locked position, the S-shaped protrusion on the distal end of the inner container is gripped and is rotated manually, either in a clockwise or anti-clockwise direction in order to engage the locking means of the inner container with the at least one lug of the housing.

In the unlocked position, the locking means on the outer surface near the distal end of the inner container, disengages from the at least one lug on the inner surface of the housing upon rotation of the inner container either in a clockwise or anti-clockwise direction opposite to the direction of locked position using the S-shaped protrusion.

According to yet another aspect of the present disclosure, a piston member is sealingly and slidingly received in the inner container above the base plug. In other words, inserted into an inner lower side of the inner container to push up the liquid product. The piston member is movable along the longitudinal axis of the inner container and reaches near the proximal end of the inner container when the liquid product inside the inner container is completely used.

According to yet another aspect of the present disclosure, the horizontal wall of the base plug includes a through-hole through which ambient air is sucked from an outside environment to drive the piston member in the inner container forwardly against the product to be sucked up.

Further, the housing comprises a plurality of slots that are arranged in the inner circumference of the housing near the proximal end for engaging the slots with a corresponding annular protrusion present at an outer circumference of the collar in order to secure the housing with the collar.

According to yet another aspect of the present disclosure, the collar comprises an inner hollow skirt having features to couple with the pump assembly of the dispenser so as to hold the pump assembly in place such that a lower portion of the pump assembly extends inside a hollow cavity of the inner container while an upper portion of the pump assembly extends inside the inner hollow skirt of the collar.

The pump assembly is preferably a vacuum sealed pump assembly. The term vacuum sealed suction refers to a pump assembly that undergoes suction and dispenses the stored liquid product from the inner container upon applying pressure in essentially a single direction without permitting reverse (intake) flow of air via the pump assembly. As the liquid product is sucked from the inner container, the sucked liquid product is not replaced with a corresponding volume of air through the pump assembly. In addition to preventing the reverse intake or flow of air, the vacuum sealed pump assembly typically does not allow the intake of any other substances to replace the volume of liquid product sucked out of the inner container. For example, a vacuum sealed pump assembly includes a one-way valve, such as a check valve. The pump assembly allows for an adjustable amount of liquid product to be dispensed, depending on how far the dispensing head is pressed in a downward direction with respect to the housing or how many times the dispensing head is pressed in the downward direction, thereby supporting a manually controlled dispensing of the liquid product.

The vacuum sealed pump assembly further includes a cup shaped body, an annular fluid tight piston, a check valve, a spring, a retaining element and a hollow elongated stem. The check valve is disposed on the proximal end of the cup shaped body. The check valve allows a one-way suction of the liquid product stored inside the inner container, wherein the one-way suction is typically from the proximal end to the distal end of the pump assembly. The pump assembly comprises the cup-shaped body delimiting a chamber for suction/compression of the cosmetic product to be dispensed, in which the hollow stem extends at least partially. The chamber is delimited by a wall of the cup-shaped body, the one-way check valve designed to close a hole for inlet of the product to be dispensed into said chamber, the annular piston, and the widened end portion of the stem.

The cup-shaped body comprises an outer rim which is received in an inner groove present in the retaining element and wherein the retaining element is engaged at the open proximal end of the cup-shaped body.

The annular piston is slidable in a fluid-tight way on the inner surface of the chamber of the cup shaped body, and on a lower end of the hollow stem. The spring, an upper end of which bears upon a projecting collar of the stem, the projecting collar is made of a single piece with the stem at an upper end portion of said stem.

According to yet another aspect of the present disclosure, the retaining element retains the other lower end of said spring. Further, the retaining element is designed to fasten the pump assembly stably to an inner hollow skirt of the collar. The retaining element has an outer skirt that is fastened to the inner hollow skirt of the collar. More particularly, the outer skirt of the retaining element has at least one groove that engages with the at least one protrusion of the inner hollow skirt of the collar.

The annular piston being mobile between a first position and at least a second position. In the first position, the annular piston closes in a fluid-tight way, under the thrust of said spring at least one hole that traverses the thickness of the stem in the proximity of its first end and opens into the cavity of the stem. More particularly, said annular piston bears in a fluid-tight way upon a widened end portion of the stem that is fastened to said stem and closes said cavity of the stem and blocks the connection between said chamber and the cavity of the stem itself.

In the second position, by compressing the spring by pressing the dispensing head, the annular piston is raised away from said at least one hole of the stem and from said widened end portion, enabling the cosmetic product present in the chamber to be dispensed, passing through said hole and cavity made in the stem.

Preferably, the stem comprises at least one first hollow tubular element and a second hollow tubular element, which are partially inserted into one another and have features designed to fasten them together. The first tubular element extends at least partially on the outside of the cup-shaped body and has the collar for resting the upper end of the spring. The second tubular element presents the inlet hole of the cavity of the stem and also comprises the widened end portion for resting of the annular piston.

The first hollow tubular element of the stem has, at its top mouth an annular inner groove for snap coupling with a corresponding protrusion of the dispensing head. The spring, the annular piston, and the retaining element are hollow so that they can be fitted over the stem.

In the present embodiment, the collar is connected to the housing, the pump assembly, and the dispensing head. Further, there is provided an O-ring like structure made up of a soft material, preferably a rubber, and has a diameter equivalent to the circumference of the opening at the proximal end of the inner container. The O-ring is positioned at the top of the opening at a rim on the proximal end of the inner container and below an inner step present at the hollow inner skirt of the collar. The O-ring seal is incorporated to ensure a leak-proof relationship between the collar and the inner container.

A proximal opening at the open proximal end of the housing is enclosed by the collar. The dispensing head can be provided in various shapes and sizes and is selected based on the inner circumference of the open proximal end of the housing.

According to yet another aspect of the present disclosure, the dispensing head having a body and a neck extending downwardly from the body. The dispensing head is connected to the stem of the pump assembly by a snap fitment at the proximal end of the stem. Further, the dispensing head has at least one outlet on an outer surface of the body for dispensing the liquid product from the inner container. More particularly, dispensing head at one side thereof has an outlet through which the liquid product is discharged. The dispensing head includes a passageway in the dispensing head that is connected with a passageway of the stem of the pump assembly.

To use the dispenser, the housing is held by one hand, the dispensing head is pressed so that it moves downward to actuate the pump assembly, and thus the liquid product is discharged to the outlet for use.

According to an embodiment, the dispensing head is coupled to an upper portion of the pump assembly through snap fitment. Further, the body of the dispensing head is accessible to a user for pushing the dispensing head downwardly along the longitudinal axis and thus actuating the pumping.

The dispensing head is configured to move in a predefined direction with respect to the housing to have a rest position and an active position with respect to the housing.

The inner container is removed from the housing and replaced with a filled new inner container upon the complete usage of the liquid product. The inner container is removed by disengaging the inner container by the locking means from the at least one lug of the housing. The inner container is disengaged from the housing by rotating the inner container by gripping the S-shaped protrusion present beneath the base plug at the distal end of the inner container. When the locking means is disengaged and the inner container slides out in the downward direction.

According to an aspect of the present disclosure, the new inner container comes with a protective seal at the proximal end that is removed before use and before fitting the inner container within the housing. The new inner container is held by the S-shaped protrusion and inserted inside the housing till the inner container is fully inserted in the housing. The inner container is rotated in the locking direction and the locking means present in the inner container engages with the at least one lug in the housing.

According to another aspect of the present disclosure, when the inner container is engaged within the housing a complete length of the sidewall of the inner container is covered by the housing such that only the base plug of the inner container is accessible to a user through the open distal end of the housing. More particularly, for rotating the inner container only the S-shaped protrusion at the underside of the inner container provides a convenient surface for gripping to the user.

According to an alternate embodiment, the pump assembly may be a dip tube.

According to an embodiment, the housing and the inner container are cylindrical shapes. However, the shape of the housing and the inner container is chosen from rectangular, elliptical, cubical, cuboidal, and other such shapes known in the art.

In alternate embodiments, the inner container may be made integrally in a single piece with the base plug.

A dispenser according to a second embodiment of the present disclosure. The dispenser is similar in construction and working to the dispenser of the first embodiment except for some minor modifications in shape and size of the components. The dispenser includes an outer housing, an inner container removably received within and coupled to said housing, collar attached at a proximal end of the housing, a pump assembly attached to the collar, a piston member received in the cavity of the inner container below a liquid product stored therein, and a dispensing head attached to an upper end of the pump assembly for dispensing and actuating the dispensing of the liquid product from the inner container to outside.

The inner container comprises a base plug that closes an open distal end of the inner container. The base plug is similar to the base plug of the first embodiment except in that it has an additional cylindrical skirt that extends upwards from an inner surface of a horizontal wall of the base plug. The skirt abuts a lower surface of the piston member such that a gap is maintained between the piston member and the inner container's bottom which is defined by the inner surface of the horizontal wall of the base plug The inner container of the second embodiment also comprises J-lock means as detachable means for easily engaging and disengaging with the housing. The J-lock means in the second embodiment engages the inner container with the housing when the inner container is rotated in a clockwise direction and disengages when rotated in an anti-clock wise direction with respect to the housing, unlike in the first embodiment where J-lock means engages the inner container with the housing when the inner container is rotated in an anti-clockwise direction and disengages when rotated in a clockwise direction with respect to the housing.

Furthermore, in the second embodiment, the collar is coupled to the cup shaped body for securing the pump assembly. More particularly, the cup-shaped body comprises a center cup, a horizontal outer flange, and an outer skirt extending upwardly from the outer flange. The center cup of the cup-shaped body at least partially houses an annular fluid-tight piston a check valve a retaining element and a hollow elongated stem. The check valve is seated on the proximal end of the cup-shaped body. Furthermore, unlike the first embodiment, one end of the spring of the second embodiment bears upon an inner surface of the dispensing head and the other end of the spring bears upon the horizontal outer flange of the cup-shaped body.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the disclosure. In addition, those skilled in the art may readily change or modifications to the disclosed embodiments, based on the present specification, such changes or modifications also belong to the scope of the present disclosure will be apparent.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
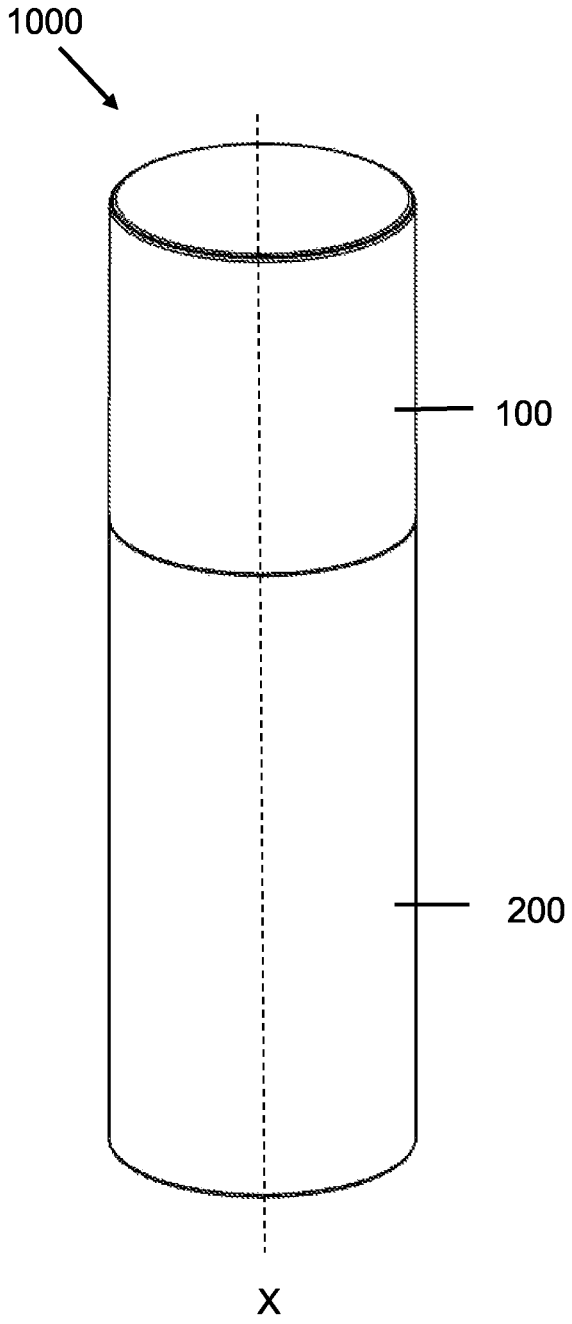
FIG. 1 illustrates a front view of a dispenser according to a first embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

Throughout this specification, the terms "comprise," "comprises," "comprising" and the like, shall consistently mean that a collection of objects is not limited to those objects specifically recited.

FIGS. 1 to 4 illustrates a dispenser 1000 in accordance with an embodiment of the present disclosure. The dispenser 1000 comprises a housing 200, a replaceable inner container 300, a dispensing head 400, a pump assembly 700, a collar 710 and a top cover 100. The inner container 300 and the pump assembly 700 are connected to the housing 200. The inner container 300 stores a liquid product (not shown) which is to be dispensed on to a surface, wherein the liquid product is selected from at least one of the cosmetic liquid products or medicinal liquid products. The liquid product stored in the inner container 300 is a flowable liquid product for e.g. a solution, suspension, a viscous liquid etc.

The replaceable inner container 300 is detachably attached to the housing 200 such that the housing 200, the collar 710, the pump assembly 700 and the dispensing head 400 can be reused while the inner container 300 can be replaced or refilled when the cosmetic product accommodated inside the inner container 300 has been completely exhausted.

Figure 2:
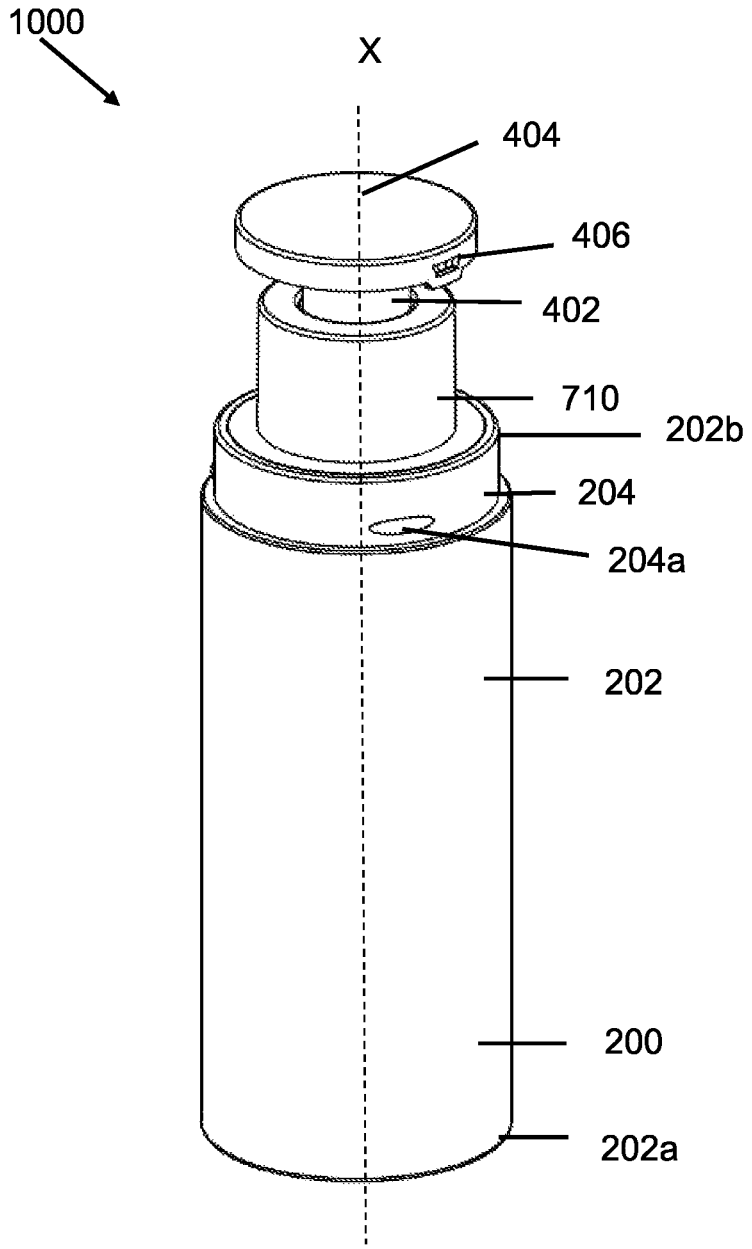
FIG. 2 illustrates an isometric view of the dispenser of FIG. 1.
Figure 3:
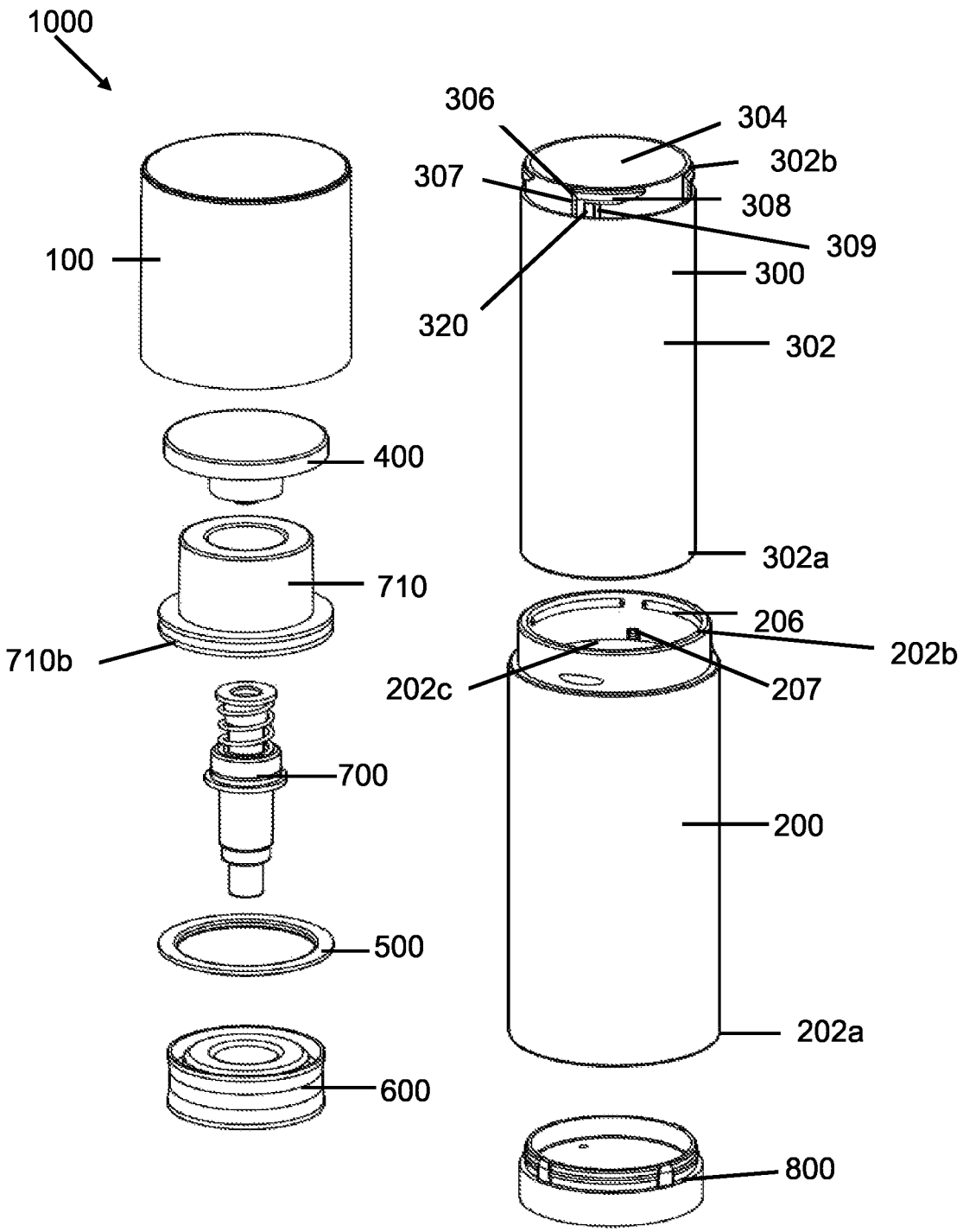
FIG. 3 illustrates an exploded view of the dispenser of FIG. 1.

As shown in FIGS. 2-3 the housing 200 has a side wall 202 extending along a central longitudinal axis X and has an open distal end 202*a* and an open proximal end 202*b* forming a hollow cavity 202*c*.

A top cover 100 is detachably mounted on a neck 204 of the housing 200 to prevent the accumulation of dirt and dust inside the inner container 300. The top cover 100 slidably fits on the neck 204 of the housing 200 by means of a snap fitment between at least one groove 102 on an inner surface of the top cover 100 and at least one corresponding protrusion 204*a* on an outer surface of the neck 204, as shown in FIG. 4.

In alternate embodiments, the top cover 100 and the housing 200 may be coupled by any other engagement means capable of removably coupling the top cover 100 and the housing 200 for e.g. j-lock, magnetic engagement, screw threads etc.

In certain embodiments, the housing 200 may include a window or made up of a transparent material formed in the side wall 202 to reveal the inner container 300 positioned coaxially inside the housing 200. Optionally, the inner container 300 may be made of transparent material or have transparent window so that through the window of the housing the product stored inside the inner container 300 may be made visible.

Figure 4:
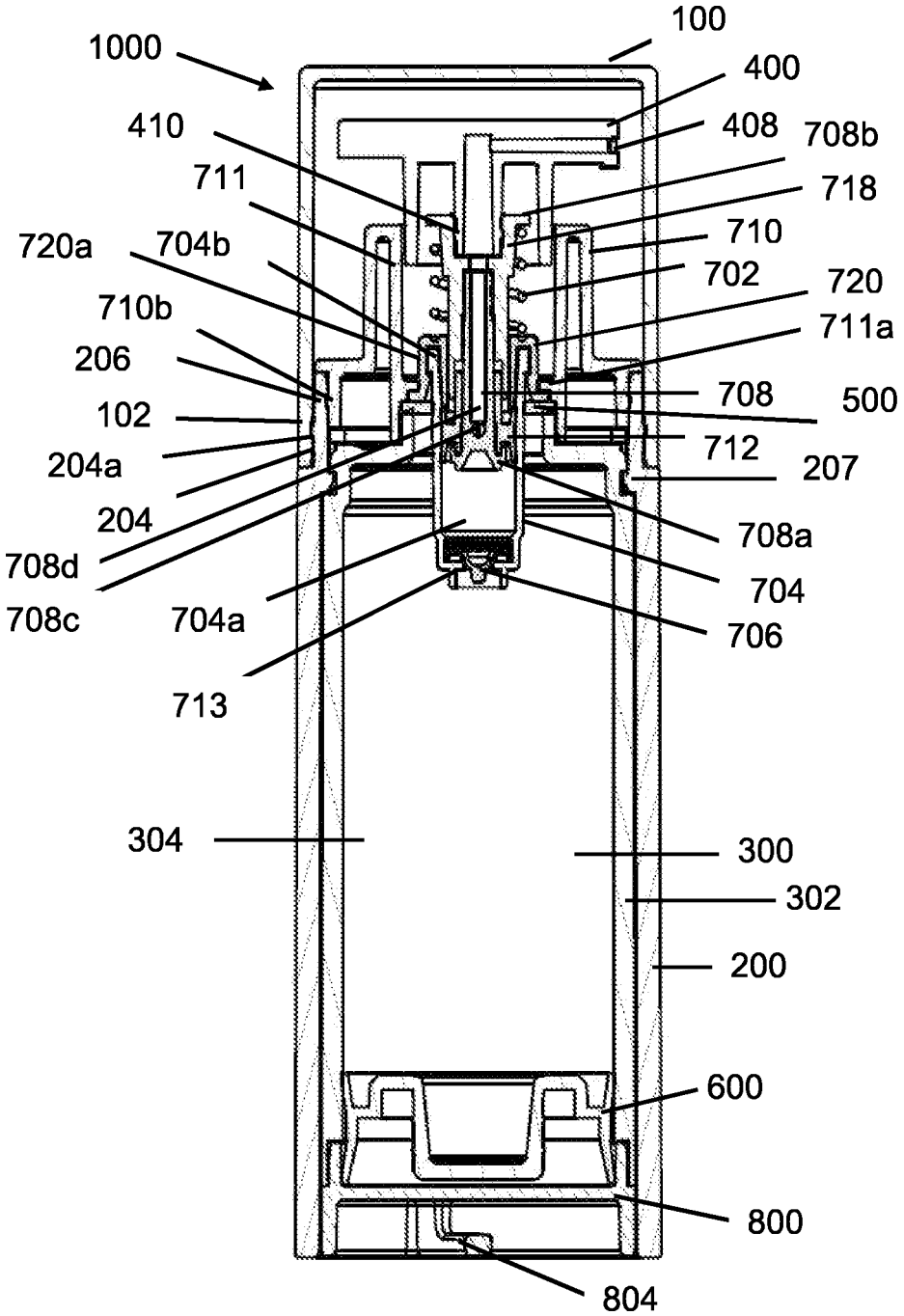
FIG. 4 illustrates a cross section view of the dispenser of FIG. 1.
Figure 5:
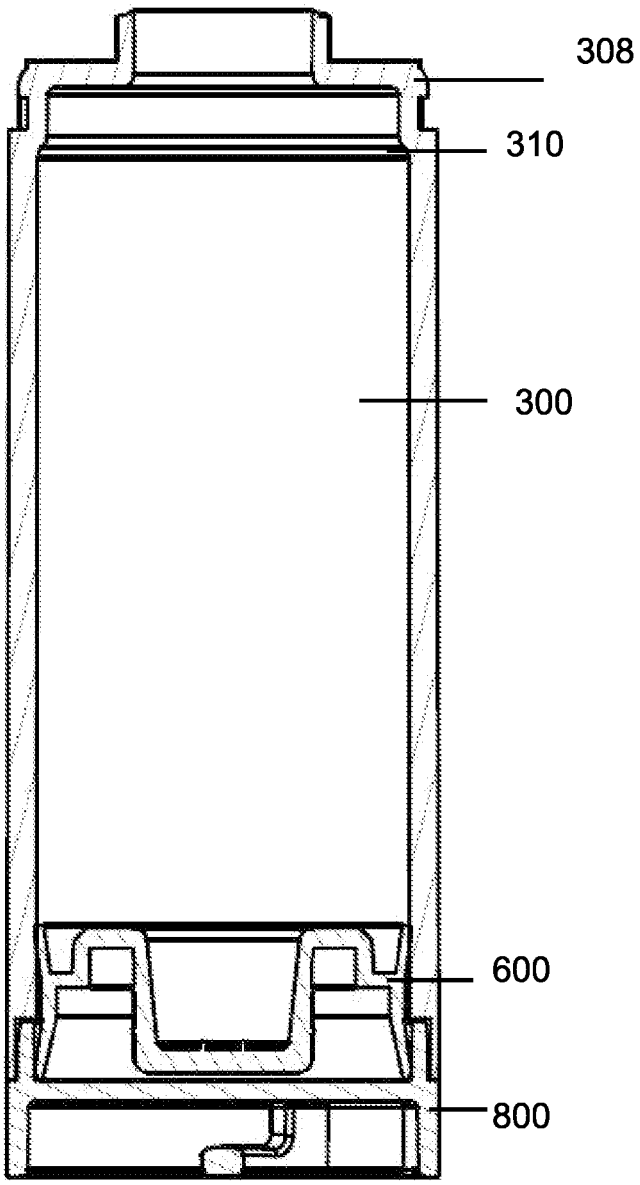
FIG. 5 illustrates a front cross-sectional view of a replaceable inner container of the dispenser of FIG. 3.

As shown in FIG. 4, the inner container 300 is positioned co-axially inside the hollow cavity 202*c* of the housing 200 for storing the liquid product. The inner container 300 comprises a hollow tubular body 302 and a base plug 800. The hollow tubular body 302 has an open distal end 302*a* and an open proximal end 302*b*, refer FIG. 3. The base plug 800 is coupled at the open distal end 302*a* of the hollow tubular body 302 and wherein the base plug 800 defines a bottom for the inner container 300 as seen in FIG. 4. The base plug 800 is fixedly coupled to the tubular body 302 such that they behave as a single unit.

The open distal end 302*a* of the inner container 300 detachably fits within the open proximal end 202*b* of the housing 200 as shown in FIG. 3. As shown in FIGS. 1 and 3, locking means 306 are present on the outer circumference of the open proximal end 302*b* of the inner container 300. The locking means 306 of the inner container 300 allows the inner container 300 to be rotatably coupled to a corresponding locking means 207 of the housing 200 in a removable manner. The locking means 306 in the present embodiment preferably a J-lock 306 formed on the outer surface of the inner container 300 which easily engages and disengages with the housing 200. The locking means 306 has a vertical rib 307 and a lateral rib 308 extending in a circumferential direction. Further, the locking means 306 has a protrusion 309 below the lateral rib 308 forming a groove 320 with the vertical rib 307 in which the at least one lug 207 of the housing is engaged in order to removably secure the inner container 300 inside the housing 200 see FIG. 4. The inner container 300 is thereby connected to the housing 200 using a J-lock which is easily connected and disconnected.

In alternate embodiments, the locking means for detachably coupling the housing 200 with the inner container 300 may be any other means than a J-lock such as a magnetic engagement, screw threads, etc. known in the art.

The inner container 300 is rotated with respect to the housing 200 for replacing the inner container 300 and in order to rotate the inner container 300 a user grips and rotates a bottom of the base plug 800 through the open distal end 202*a* of the housing 200. The base plug 800 is thus rotated slightly along the circumference of the inner circumference of the housing 200 to lock and unlock the locking means 306 of the inner container 300 from the at least one lug 207 of the housing 200 for replacing the inner container 300. In the locked position, the at least one lug 207 of the housing 200 is present in the groove 320 of the at least one locking means 306 of the inner container 300.

In order, to unlock, the inner container 300 from the housing 200 for replacement, the inner container 300 is rotated in a first direction preferably in an anti-clockwise direction. As the inner container 300 is rotated in the first direction, the at least one lug 207 of the housing 200 comes out of the groove 320 by overriding the protrusion 309 and moves in a circumferential direction along the lateral rib 308 and disengaging from the locking means 306 of the inner container 300.

In order to lock a new inner container 300 with housing 200, the inner container 300 is fully inserted in the hollow cavity 202*c* of the housing 200 through the distal end 200*a* of the housing 200 and is rotated in a direction opposite to the first direction i.e. preferably in a clockwise direction. As the new inner container 300 is rotated, the at least one lug 207 of the housing 200 moves along the circumferential surface of the lateral rib 308 of the locking means 306 and the at least one lug 207 enters into the groove 120 by overriding the protrusion 309 of the locking means 306 for locking the new inner container 300 to housing 200.

In the exemplary embodiment, the inner container 300 and the base plug 800 are not integral however, in alternate embodiment, the inner container 300 and the base plug 800 may be made as a single integral piece or made up of two pieces.

According to an aspect of the present disclosure, the base plug 800 provides a gripping means on the underside of the base plug 800. In a preferred embodiment, the gripping means includes a protrusion 804 on the underside of the base plug 800 that allows a user to comfortably grip the inner container 300 from a bottom side during rotation of the inner container 300 for locking and unlocking the inner container 300 from the housing 200.

Figure 6:
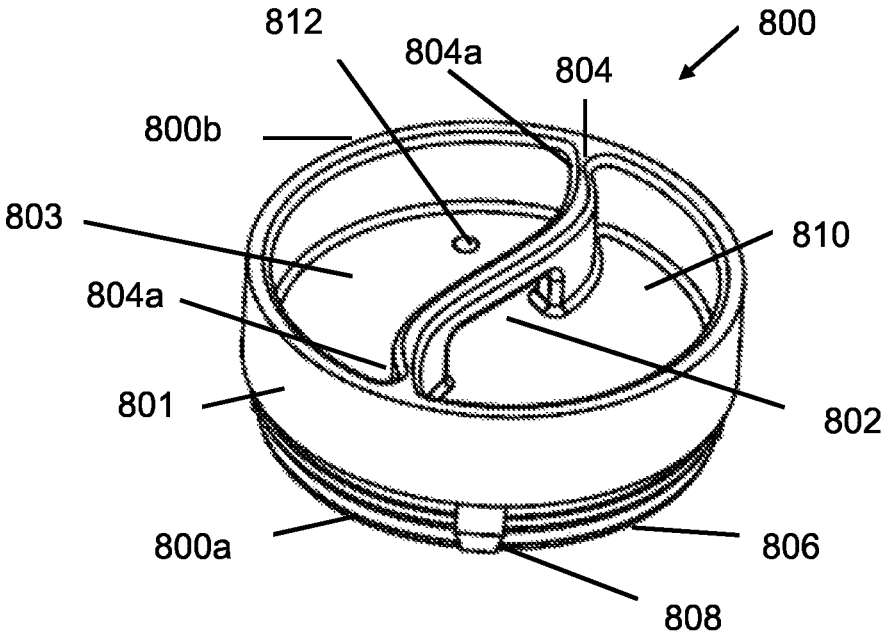
FIG. 6 illustrates a bottom perspective view of a base plug of the replaceable inner container of FIG. 6.

According to FIG. 6, the base plug 800 comprises of sidewall 801 having a proximal end 800*a* and a distal end 800*b*, and a horizontal wall 803. The horizontal wall 803 is set inwardly of and spaced from a distal end of the sidewall 801 of the base plug 800. A bottom surface of the horizontal wall 803 along with a sidewall 801 of the base plug 800 forms a recess 810 at bottom of the base plug 800. The base plug 800 further includes an S-shaped protrusion 804 as a gripping means provided on the bottom surface of the horizontal wall 803 of the base plug 800 that extends towards the distal end 800*b*. A depth of the recess 810 is substantially more than half of a height of the base plug 800. A length of the S-shaped protrusion 804 is equal to greater than a width of the base plug 800. In the exemplary embodiment, S-shaped protrusion 804 extends in the recess 810 of the base plug 800 such that a first end 804*a* of the S-shaped protrusion 804 is joined to an inner circumference of the sidewall 801 of the base plug 800, and a second end 804*b* of the S-shaped protrusion 804 is joined to the inner circumference of the sidewall 801 of the base plug 800 in a region substantially opposite to a joining region of the first end 804*a*.

A height of the S-shaped protrusion 804 is equal to the depth of the recess 810, and wherein the S-shaped protrusion extends from the bottom surface of the horizontal wall 803 to the distal end 800*b* of the base plug 800. Further, an aperture 802 is provided within the S-shaped protrusion 804 in which inwardly curled fingers of a user can locate and engage. This allows the user to securely grip the base plug 800 of the inner container 300 in a comfortable and natural manner. Thus, aperture 802 creates a ring or grip for the user to grasp the S-shaped protrusion 804 and rotate the inner container 300. The dimension selected for the aperture 802 provides a defined space for a user to place a finger to hold the base plug 800. The aperture 802 is located at about a mid-length of the S-shaped protrusion 804 and has a length substantially less than half of the length of the S-shaped protrusion 804. The height of the aperture 802 is more than half of the height of the S-shaped protrusion 804.

In alternate embodiments, the S-shaped protrusion 804 may be of any other shape other than an S-shape as long as it provides a comfortable gripping surface with or without an aperture in it in which a user can insert his/her finger.

An outer surface of the sidewall 801 of the base plug 800 proximate to the proximal end 800*a* of the base plug 800 comprises of multiple protrusions 808 on an outer circumference of the base plug 800. The multiple protrusions 808 engage with the corresponding snap grooves (not shown) provided on the inner circumference of the sidewall of the hollow tubular body 302 of the inner container 300 proximate to the open distal end 302*a*.

The base plug 800 engages with the inner container 300 by rotating the base plug 800 at a certain degree in either clockwise or anti-clockwise direction, such that each of the protrusions 808 on the outer surface of the base plug 800 perfectly align with each of the snap grooves of the inner container 300.

During engagement and disengagement of the base plug 800 from the housing 200, the user places the finger inside the aperture 802 and holds the S-shaped protrusion 804 firmly to rotate the inner container 300 at a certain degree in a particular direction.

According to an embodiment, the length of the S-shaped protrusion 804 ranges from about 15 mm-45 mm, more preferably about 25 mm-35 mm. The height of the S-shaped protrusion 804 ranges from 3 mm-9 mm, more preferably from 4 mm-7 mm. The width of the S-shaped protrusion 804 ranges from 1 mm-3.5 mm, preferably from 1.5 mm-2.5 mm. According to an alternate embodiment, the height and width of the S-shaped protrusion 804 may vary along its length.

According to a first embodiment, the height of the aperture 802 is preferably 3.3 mm, the length is preferably 10 mm, and the width is preferably 1.9 mm. However, according to an alternate embodiment, the dimension of the aperture 802 may vary.

In the locked position, as shown in FIG. 4, the S-shaped protrusion 804 on the distal end 302*a* is gripped and the inner container 300 is rotated manually, either in a clockwise or anti-clockwise direction in order to engage the locking means 306 of the inner container 300 with the at least one lug 207 of the housing 200.

In the unlocked position, the locking means 306 on the outer surface near the proximal end 302*b* of the inner container 300, disengages from the at least one lug 207 on the inner surface of the housing 200 upon rotation of the inner container 300 either in a clockwise or anti-clockwise direction opposite to the direction of locked position using the S-shaped protrusion 804.

As shown in FIG. 3, a piston member 600 is sealingly and slidingly received in the inner container 300 above the base plug 800 of the inner container 300. The piston member 600 is movable along the longitudinal axis X of the inner container 300, and reaches near the open proximal end 302*b* of the inner container 300 when the liquid product inside the inner container 300 is completely used.

The base plug 800 in the horizontal wall 803 includes a through hole 812 through which ambient air is sucked from an outside environment to drive the piston member 600 in the inner container 300 forwardly against the product to be sucked up.

Further, the housing 200 comprises a plurality of slots 206 that are arranged in the inner circumference of the housing 200 near the open proximal end 202*b* for engaging the slots 206 with a corresponding annular protrusion 710*b* present at an outer circumference of the collar 710 in order to secure the housing 200 with the collar 710, see FIGS. 3-4.

The collar 710 comprises an inner hollow skirt 711 having features 711*a* to couple with the pump assembly 700 of the dispenser 1000 so as to hold the pump assembly 700 in place such that a lower portion of the pump assembly 700 extends inside a hollow cavity 304 of the inner container 300 while an upper portion of the pump assembly 700 extends inside the inner hollow skirt 711 of the collar 710.

The pump assembly 700 is preferably a vacuum sealed pump assembly 700. The term vacuum sealed suction refers to a pump assembly 700 that undergoes suction and dispenses the stored liquid product from the inner container 300 upon applying pressure in essentially a single direction without permitting reverse (intake) flow of air via the pump assembly 700. As the liquid product is sucked from the inner container 300, the sucked liquid product is not replaced with a corresponding volume of air through the pump assembly 700. In addition to preventing the reverse intake or flow of air, the pump assembly 700 typically does not allow the intake of any other substances to replace the volume of liquid product sucked out of the inner container 300. For example, the pump assembly 700 includes a one-way check valve 706, such as a check valve 706. The pump assembly 700 allows for an adjustable amount of liquid product to be dispensed, depending on how far the dispensing head 400 is pressed in a downward direction with respect to the housing 200 or how many times the dispensing head 400 is pressed in the downward direction, thereby supporting a manually controlled dispensing of the liquid product.

As shown in FIG. 4, the pump assembly 700 further includes a cup-shaped body 704, an annular fluid-tight piston 712, a check valve 706, a spring 702, a retaining element 720 and a hollow elongated stem 708. The check valve 706 is disposed on a proximal end of the cup-shaped body 704. The check valve 706 allows a one-way suction of the liquid product stored inside the inner container 300, wherein the one-way suction is typically from the proximal end to the distal end of the pump assembly 700. The pump assembly 700 comprises the cup-shaped body 704 delimiting a chamber 704*a* for suction/compression of the cosmetic product to be dispensed, in which the hollow stem 708 extends at least partially. The chamber 704*a* is delimited by: a wall of the cup-shaped body 704; the one-way check valve 706 designed to close a hole 713 for inlet of the product to be dispensed into said chamber 704*a*; the annular piston 712; and the widened end portion 708*a* of the hollow stem 708.

The cup-shaped body 704 comprises an outer rim 704*b* which is received in an inner groove 720*a* present in the retaining element 720.

The annular piston 712 is slidable in a fluid-tight way on the inner surface of the chamber 704*a*, and on a lower end of the hollow stem 708. The spring 702, an upper end of which bears upon a projecting collar 708*b* of the hollow stem 708, the projecting collar is made of a single piece with the hollow stem 708 at an upper end portion of said hollow stem 708.

The retaining element 720 retains the other lower end 702*b* of said spring 702. Further, the retaining element 720 is designed to fasten the pump assembly 700 stably to the inner hollow skirt 711 of the collar 710. The retaining element 720 has an outer skirt that is fastened to the inner hollow skirt 711 of the collar 710. More particularly, the outer skirt of the retaining element 720 has at least groove 720*b* that engages with the at least one protrusion 711*a* of the inner hollow skirt 711 of the collar 710.

The annular piston 712 being mobile between a first position and at least a second position. In the first position, the annular piston 712 closes in a fluid-tight way, under the thrust of said spring 702 at least one hole 708*c* that traverses the thickness of the hollow stem 708 in the proximity of its first end near the widened end portion 708*a* and opens into the cavity 708*d* of the hollow stem 708. More particularly, said annular piston 712 bears in a fluid-tight way upon a widened end portion 708*a* of the hollow stem 708 that is fastened to said hollow stem 708 and closes said cavity 708*d* of the hollow stem 708 and blocks the connection between said chamber 704*a* and the cavity 708*d* of the hollow stem 708 itself.

In the second position, not shown, by compressing the spring 702 by pressing the dispensing head 400, the annular piston 712 is raised away from said at least one hole 708*c* of the hollow stem 708 and from said widened end portion 708*a*, enabling the cosmetic product present in the chamber 704*a* to be dispensed, passing through said inlet hole 708*c* and cavity 708*d* made in the hollow stem 708.

Preferably, the hollow stem 708 comprises at least one first hollow tubular element 718 and a second hollow tubular element 719, which are partially inserted into one another and have features designed to fasten them together. The first hollow tubular element 718 extends at least partially on the outside of the cup-shaped body 704 and has the collar 708*b* for resting the upper end of the spring 702. The second hollow tubular element 719 presents the inlet hole 708*c* of the cavity 708*d* of the hollow stem 708 and also comprises the widened end portion 708*a* for resting of the annular piston 712.

The first hollow tubular element 718 of the stem 708 has, at its top mouth an annular inner groove for snap coupling with a corresponding protrusion 410 of the dispensing head 400.

The spring 702, the annular piston 712, and the retaining element 720 are hollow so that they can be fitted over the hollow stem 708, see FIG. 4.

In the present embodiment, the collar 710 is connected to the housing 200, the pump assembly 700, and the dispensing head 400. Further, there is provided an O-ring like structure 500 made up of a soft material, preferably a rubber, and has a diameter equivalent to the circumference of the opening at the proximal end of 302*b* of the inner container 300. The O-ring 500 is positioned at the top of the opening at a rim on the proximal end of 302*b* of the inner container 300 and below an inner step present at the inner hollow skirt 711 of the collar 710, see FIG. 4. The O-ring 500 seal is incorporated to ensure a leak-proof relationship between the collar 710 and the inner container 300.

A proximal opening at the open proximal end 202*b* of the housing 200 is enclosed by the collar 710. The dispensing head 400 can be provided in various shapes and sizes and is selected based on the inner circumference of the open proximal end 202*b* of the housing 200.

As shown in FIGS. 2-4, the dispensing head 400 having a body 404 and a neck 402 extending downwardly from the body 404. The dispensing head 400 is connected to the hollow stem 708 of the pump assembly 700 by a snap fitment at the proximal end of the hollow stem 708. Further, the dispensing head 400 has at least one outlet 406 on an outer surface of the body 404 for dispensing the liquid product from the inner container 300 as shown in FIGS. 3 and 4. The dispensing head 400 includes a passageway 408 in the dispensing head 400 that is connected with a passageway of the hollow stem 708 of the pump assembly 700.

To use the dispenser, the housing 200 is held by one hand, the dispensing head 400 is pressed so that it moves downward to actuate the pump assembly 700, and thus the liquid product is discharged to the outlet 406 for use.

According to an embodiment, the dispensing head 400 is coupled to an upper portion of the pump assembly through snap fitment. Further, the body 404 of the dispensing head 400 is accessible to a user for pushing the dispensing head 400 downwardly along the longitudinal axis X and thus actuating the pumping.

The dispensing head 400 is configured to move in a pre-defined direction with respect to the housing 200 to have a rest position and an active position with respect to the housing 200.

The inner container 300 is removed from the housing 200 and replaced with a filled new inner container 300 upon the complete usage of the liquid product. The inner container 300 is removed by disengaging the inner container 300 by the locking means 306 from the at least one lug 207 of the housing 200. The inner container 300 is disengaged by rotating the inner container 300 by gripping the S-shaped protrusion 804 present beneath the base plug 800 and at the open distal end 302*a* of the inner container 300. When the locking means 306 is disengaged and the inner container 300 slides out in the downward direction.

According to an aspect of the present disclosure, the new inner container 300 comes with a protective seal at the open proximal end 302*b* that is removed before use or before fitting the inner container 300 within the housing 200. The new inner container 300 is held by the S-shaped protrusion 804 and inserted inside the housing 200 till the inner container 300 is fully inserted in the housing 200. The inner container 300 is rotated in the locking direction and the locking means 306 present in the inner container 300 engages with the at least one lug 207 in the housing 200.

According to another aspect of the present disclosure, when the inner container 300 is engaged within the housing 200 a complete length of the sidewall of the inner container 300 is covered by the housing 200 such that only the base plug of the inner container 300 is accessible to a user through the open distal end 202*a* of the housing 200.

According to an alternate embodiment, the pump assembly 700 may be a dip tube.

According to an embodiment, the housing 200 and the inner container 300 are cylindrical shapes. However, the shape of the housing 200 and the inner container 300 is chosen from rectangular, elliptical, cubical, cuboidal, and other such shapes known in the art.

In alternate embodiments, the inner container 300 may be made integrally in a single piece with the base plug 800.

Figure 7:
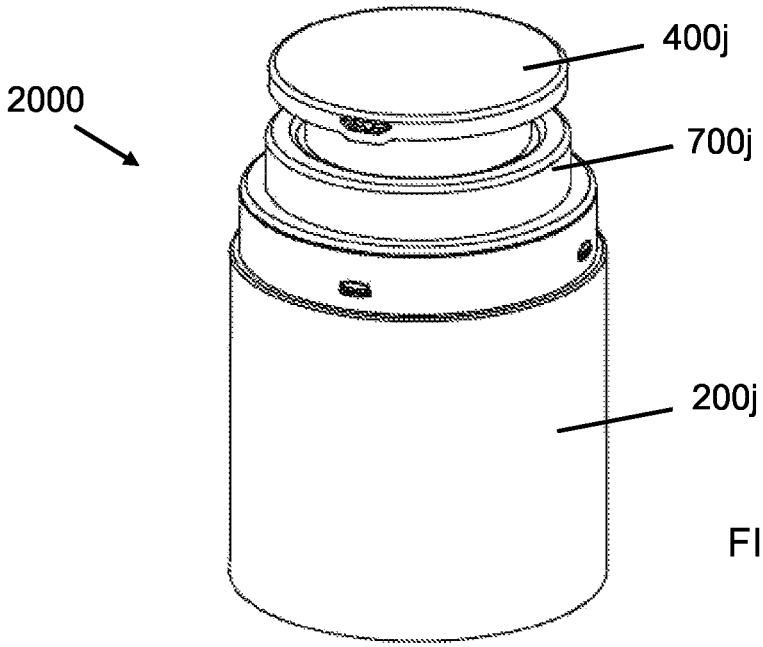
FIG. 7 illustrates a perspective view of a dispenser according to a second embodiment of the present disclosure, the dispenser is shown without a cover.
Figure 8:
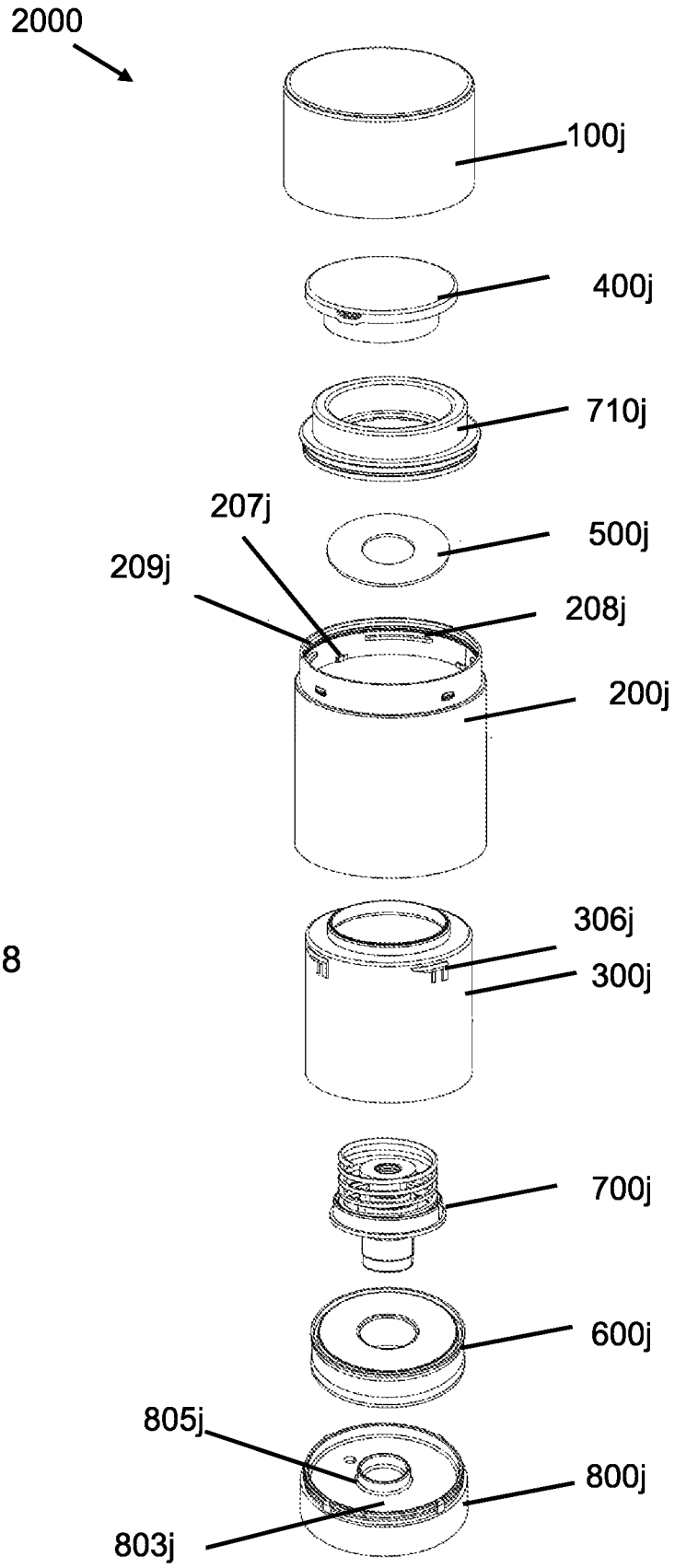
FIG. 8 illustrates an exploded view of the dispenser of FIG. 7.
Figure 9:
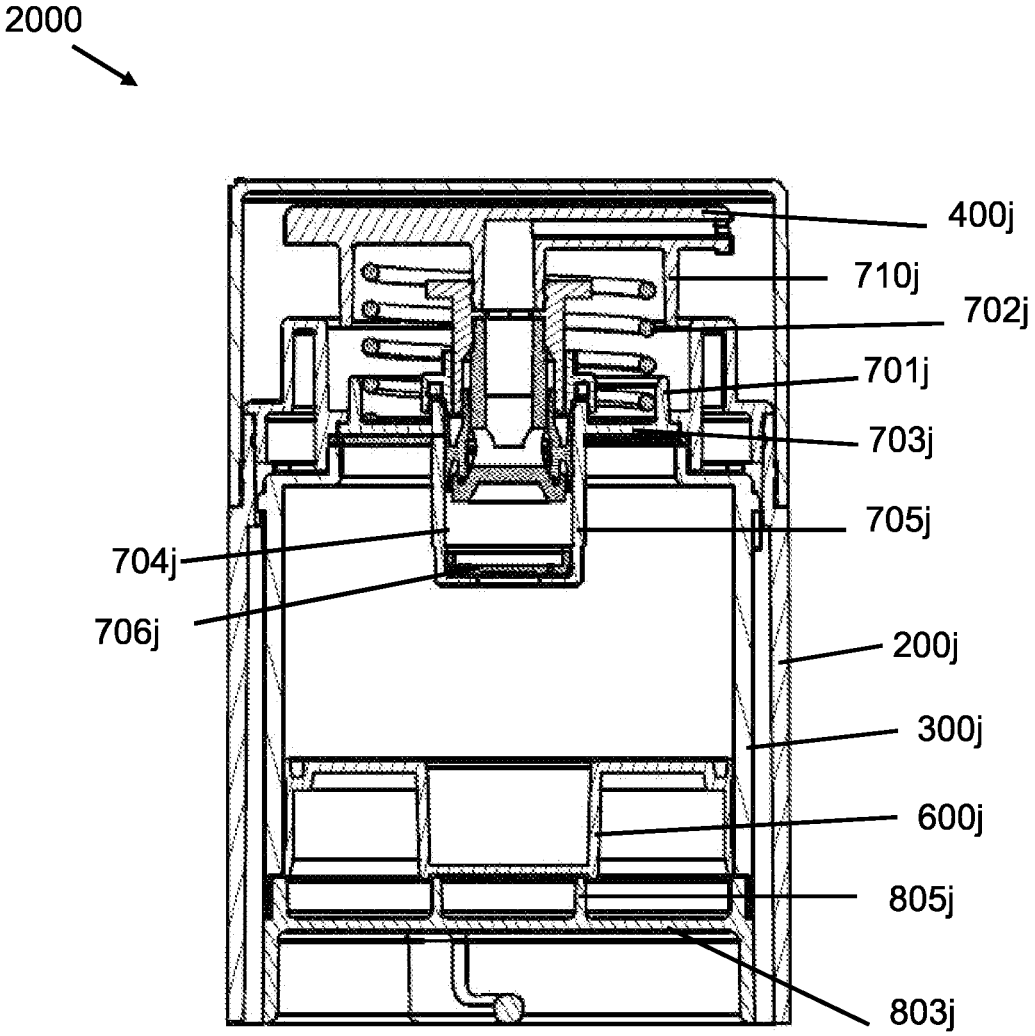
FIG. 9 illustrates a cross sectional view of the dispenser of FIG. 7.

FIGS. 7 to 9 show a dispenser 2000 according to a second embodiment of the present disclosure. The dispenser 2000 is similar in construction and working to the dispenser 1000 of the first embodiment except for some minor modifications in shape and size of the components. The dispenser 2000 includes an housing 200*j*, an inner container 300*j* removably received within and coupled to said housing 200*j*, a collar 710*j* attached at a proximal end of the housing 200*j*, a pump assembly 700*j* attached to the collar 710*j*, a piston member 600*j* received in the cavity of inner container 300*j* below a liquid product stored therein; and a dispensing head 400*j* attached to an upper end of the pump assembly 700*j* for dispensing and actuating the dispensing of the liquid product from the inner container 300*j* to outside.

As seen in FIGS. 8 to 9, the inner container 300*j* comprises a base plug 800*j* that closes an open distal end of the inner container 300*j*. The base plug 800*j* is similar to the base plug 800 of the first embodiment except in that it has an additional cylindrical skirt 805*j* that extends upwards from an inner surface of a horizontal wall 803*j* of the base plug 800*j*. The cylindrical skirt 805*j* of the base plug 800*j* abuts a lower surface of the piston member 600*j* such that a gap is maintained between the piston member 600*j* and the inner container's bottom which is defined by the inner surface of the horizontal wall 803*j* of the base plug 800*j*.

Further, as seen in FIG. 8, the inner container 300*j* comprises J-lock means as detachable means for easily engaging and disengaging with the housing 200*j*. The J-lock 306*j* means in the second embodiment engages the inner container 300*j* with the housing 200*j* when the inner container 300*j* is rotated in a clockwise direction and disengages when rotated in anti-clock wise direction with respect to the housing 200*j*, unlike in the first embodiment where J-lock means 306 engages with the corresponding locking means 207*j* the inner container 300 with the housing 200 when the inner container 300 is rotated in an anti-clockwise direction and disengages when rotated in a clockwise direction with respect to the housing 200*j*.

As shown in FIGS. 8 to 9, the corresponding locking means 207*j* of the housing 200*j* is at least one lug 207*j* present a the inner circumference of the housing 200*j* near an open proximal end of the housing 200*j*. Further, the housing 200*j* comprises at least one projection 208*j* circumferentially and axially spaced from the at least one lug 207*j* on the inner circumference of the housing 200*j*. The at least one projection 208*j* abut against an upper end of the J-lock 306*j* and aids in correctly positioning the inner container 300*j* inside the housing 200*j*. Further, the housing 200*j* includes an annular groove 209*j* on the inner circumference above the at least one projection 208*j* of the housing 200*j*. The annular groove 209*j* of the housing 200*j* engages with a corresponding annular protrusion 710*b* present at an outer circumference of the collar 710*j* to secure the housing 200*j* with the collar 710*j*.

Furthermore, in the second embodiment, the collar 710*j* is coupled to the cup shaped body 704*j* for securing the pump assembly 700*j*. More particularly, the cup shaped body 704*j* comprises a center cup 705*j*, a horizontal outer flange 703*j*, and an outer skirt 701*j* extending upwardly from the horizontal outer flange 703*j*. The center cup 705*j* of the cup shaped body 704*j* at least partially houses an annular fluid tight piston 712*j*, a check valve 706*j*, a retaining element 720*j* and a hollow elongated stem 708*j*. The check valve 706*j* is disposed on the proximal end of the cup shaped body 704*j*. Furthermore, unlike the first embodiment, one end of the spring 702*j* of the second embodiment bears upon an inner surface of the dispensing head 400*j* and the other end of the spring 702*j* bears upon the horizontal outer flange 703*j* of the cup shaped body 704*j*.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes shown herein. As another example, the materials used for various components can be different from those mentioned specifically herein.

What is claimed is:

1. A dispenser for dispensing a liquid product comprising:

a housing having an open distal end and an open proximal end;

an inner container accommodating the liquid product and configured to be inserted into a cavity of the housing;

a piston member inserted into an inner lower side of the inner container to push up the liquid product;

a collar coupled to the housing near the open proximal end of the housing;

a pump assembly coupled to the collar;

a dispensing head coupled to an upper portion of the pump assembly, the dispensing head at one side thereof has an outlet through which the liquid product is discharged;

wherein the inner container is replaceable and is detachably connected to the housing such that the housing, the collar, the pump assembly, and the dispensing head are retained for reuse while the inner container is replaced;

wherein locking means are present on an outer surface near an open proximal end of the inner container that allows the inner container to be rotatably and removably coupled to a corresponding locking means present on an inner surface of the housing near the open proximal end of the housing;

wherein the inner container comprises a hollow tubular body having an open distal end and the open proximal end, and a base plug that is fixedly coupled at the open distal end of the hollow tubular body such that the hollow tubular body and the base plug behave as a single unit;

wherein the base plug comprises of a sidewall having a proximal end and a distal end, and a horizontal wall that is set inwardly of and spaced from the distal end of the sidewall of the base plug;

wherein a bottom surface of the horizontal wall of the base plug includes an S-shaped protrusion that extends towards the distal end of the sidewall of the base plug; and wherein to disengage the inner container from the housing a user grips the S-shaped protrusion of the inner container from an open distal end of the housing and rotate the inner container in a clockwise or anticlockwise direction so that the corresponding locking means of the inner container and the housing disengages from one another.

2. A dispenser according to claim 1, wherein an aperture is provided within the S-shaped protrusion in which the user can locate and engage his or her finger.

3. A dispenser according to claim 2, wherein the aperture is located at about a mid-length of the S-shaped protrusion and has a length less than half of a length of the S-shaped protrusion, and wherein a height of the aperture is more than half of a height of the S-shaped protrusion.

4. A dispenser according to claim 1, wherein when the inner container is engaged with the housing a complete length of a sidewall of the inner container is covered by the housing such that only the base plug of the inner container is accessible to the user through the open distal end of the housing.

5. A dispenser according to claim 1, wherein the bottom surface of the horizontal wall along with the sidewall of the base plug forms a recess at bottom of the base plug.

6. A dispenser according to claim 5, wherein a height of the S-shaped protrusion is equal to a depth of the recess of the base plug, and wherein the S-shaped protrusion extends from the bottom surface of the horizontal wall to the distal end of the base plug.

7. A dispenser according to claim 1, wherein a length of the S-shaped protrusion ranges from about 15 mm to about 45 mm, and a height of the S-shaped protrusion ranges from about 3 mm to about 9 mm.

8. A dispenser according to claim 1, wherein the locking means are J-locks formed on the outer surface of the inner container; and wherein each of the J-locks on the inner container comprises a vertical rib and a lateral rib extending in a circumferential direction, and a protrusion below the lateral rib forming a groove with the vertical rib; and wherein the corresponding locking means on the inner surface of the housing is at least one lug.

9. A dispenser according to claim 8, wherein when the inner container is engaged with the housing, the at least one lug of the housing is present in the groove of the locking means of the inner container.

10. A dispenser according to claim 8, wherein to disengage the inner container from the housing, the inner container is rotated in a first direction whereby the at least one lug of the housing comes out of the groove of the locking means of the inner container by overriding the protrusion of the locking means and moves in a circumferential direction along the lateral rib for disengaging from the locking means of the inner container.

11. A dispenser according to claim 10, wherein to lock a new inner container with housing, the inner container is fully inserted in the cavity of the housing through the distal end of the housing and is rotated in a direction opposite to the first direction and wherein as the inner container is rotated, the at least one lug of the housing moves along the lateral rib of the locking means of the inner container and the at least one lug enters into the groove by overriding the protrusion of the locking means for locking the new inner container to housing.

12. A dispenser according to claim 10, wherein when the corresponding locking means of the inner container and the housing are disengaged, the inner container slides out in a downward direction.

13. A dispenser according to claim 1, wherein the housing comprises an annular groove that is arranged in an inner circumference of the housing near the proximal end for engaging with a corresponding annular protrusion present at an outer circumference of the collar to secure the housing with the collar.

14. A dispenser according to claim 1, wherein the collar comprises an inner hollow skirt having features to couple with the pump assembly of the dispenser to hold the pump assembly in place such that a lower portion of the pump assembly extends inside a hollow cavity of the inner container while an upper portion of the pump assembly extends inside the inner hollow skirt of the collar.

15. A dispenser according to claim 1, wherein pump assembly includes a cup-shaped body, an annular fluid-tight piston, a check valve, a spring, a retaining element and a hollow elongated stem.

16. A dispenser according to claim 15, wherein the dispensing head includes a passageway that is connected with a passageway of the elongated stem of the pump assembly; and wherein the dispensing head is coupled to an upper portion of the elongated stem of the pump assembly through snap fitment.

17. A dispenser according to claim 15, wherein the cup-shaped body comprises a center cup, a horizontal outer flange extending laterally from an outer surface of the center cup, and an outer skirt extending upwardly from the horizontal outer flange.

18. A dispenser according to claim 1, wherein the base plug has a cylindrical skirt that extends upwards from an inner surface of a horizontal wall of the base plug; and wherein the cylindrical skirt of the base plug abuts a lower surface of the piston member such that a gap is maintained between the piston member and the horizontal wall of the base plug of the inner container.

* * * * *